US006976943B1

(12) United States Patent
Hsiung

(10) Patent No.: US 6,976,943 B1
(45) Date of Patent: Dec. 20, 2005

(54) EXERCISE APPARATUS

(75) Inventor: Bob Hsiung, Walnut, CA (US)

(73) Assignee: Hupa International, Inc., Walnut, CA (US)

( * ) Notice: Subject to any disclaimer, the term of this patent is extended or adjusted under 35 U.S.C. 154(b) by 192 days.

(21) Appl. No.: 10/622,390

(22) Filed: Jul. 17, 2003

(51) Int. Cl.[7] ..... A63B 26/00; A63B 71/00
(52) U.S. Cl. ..... 482/141; 482/148; 482/62; 482/96
(58) Field of Search ..... 482/148, 141, 482/62, 95, 96, 907

(56) References Cited

U.S. PATENT DOCUMENTS 3,491,998 A * 1/1970 Goodwin ..... 482/142
4,795,150 A * 1/1989 Harlan ..... 482/142
5,163,890 A * 11/1992 Perry, Jr. ..... 482/142
5,507,711 A * 4/1996 Richardson ..... 482/112
5,518,470 A * 5/1996 Piaget et al. ..... 482/51
5,531,658 A * 7/1996 L. S. C. ..... 482/142
5,928,116 A * 7/1999 Chiang ..... 482/72
6,685,604 B1 * 2/2004 Muscocea ..... 482/141
6,793,609 B1 * 9/2004 Fan ..... 482/57
2003/0060347 A1 * 3/2003 Tang ..... 482/141
2004/0157706 A1 * 8/2004 Miller ..... 482/52
2004/0157711 A1 * 8/2004 Regev ..... 482/142

* cited by examiner

*Primary Examiner*—Gregory L. Huson
*Assistant Examiner*—L. Amerson
(74) *Attorney, Agent, or Firm*—Thomas I. Rozsa; Tony D. Chen

(57) ABSTRACT

An exercise apparatus to exercise and strengthen the user's arms, shoulders and chest by performing pushups which combine raising and lowering the user's body through raising and lowering the user's arms while the user is in a face down horizontal position with the present invention exercise device used to simulate an up and down pumping action to cause the user to have his/her arms spread apart to make the pushups more difficult while providing a central chest support to facilitate the exercise.

4 Claims, 3 Drawing Sheets

FIG. 3
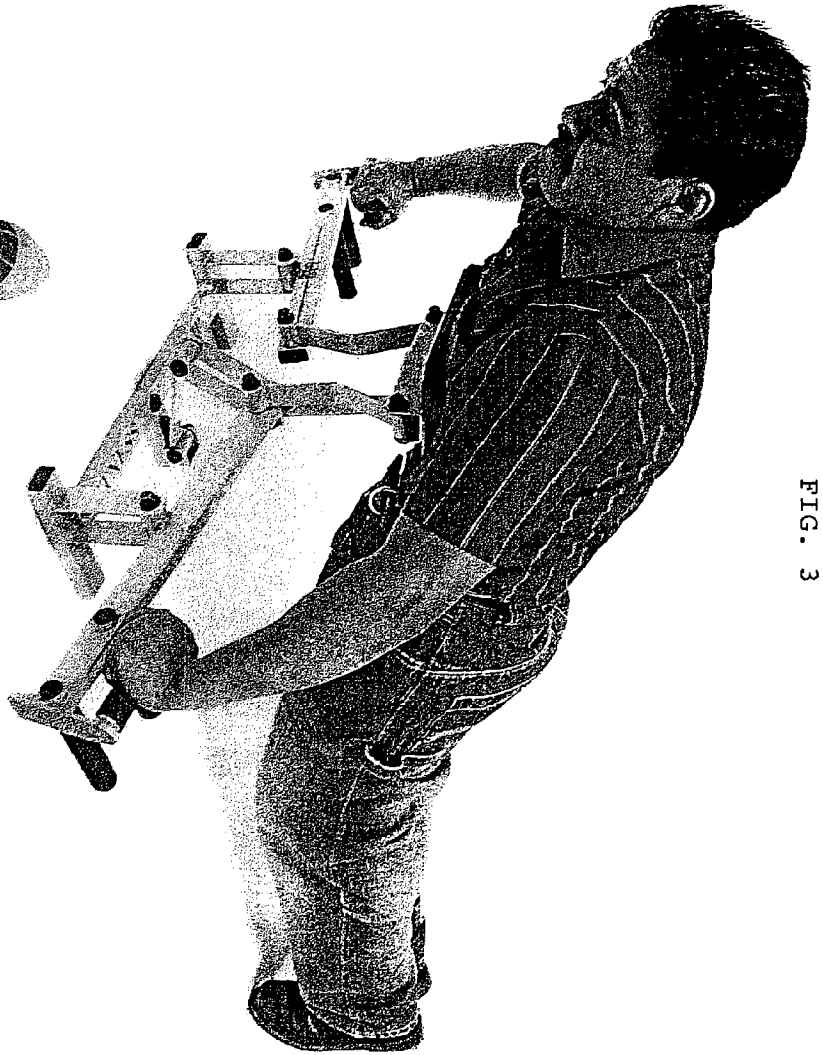
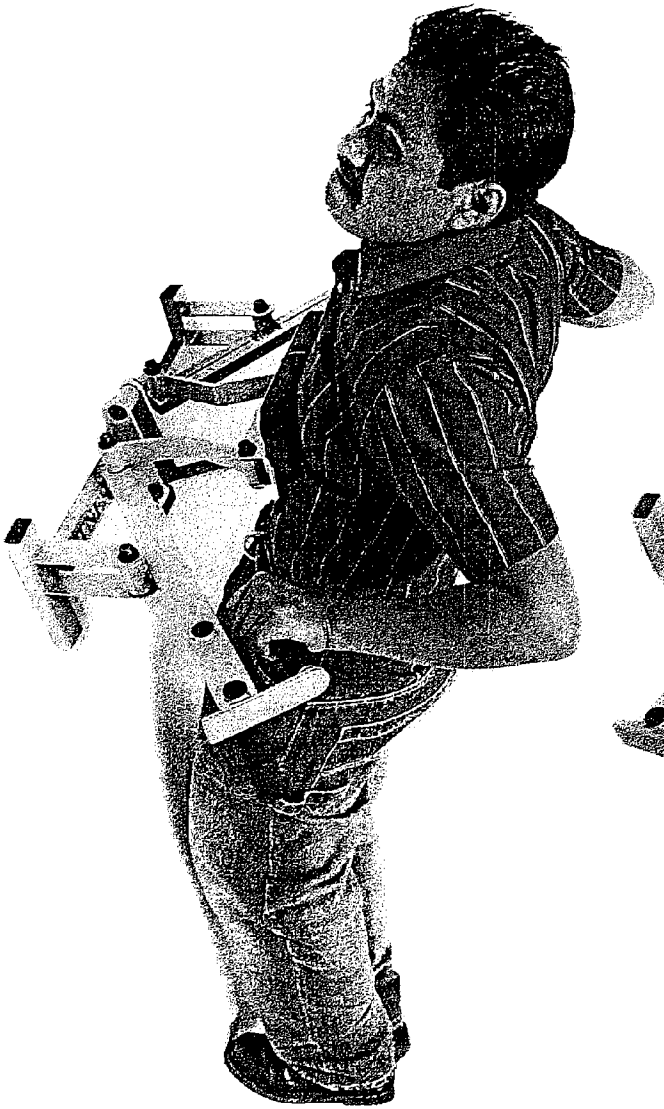
FIG. 4

EXERCISE APPARATUS

BACKGROUND OF THE INVENTION

1. Field of the Invention

The present invention relates to the general field of exercise apparatus used by individuals to maintain health and physical fitness.

2. Description of the Prior Art

There are many types of exercise apparatus which are well known in the prior art. However, to the best of the inventor's knowledge, no individual piece of prior art exercise apparatus or combination of features from different prior art exercise apparatuses incorporate the novel features of the present invention.

SUMMARY OF THE INVENTION

The present invention is an exercise apparatus to exercise and strengthen the user's arms, shoulders and chest by performing pushups which combine raising and lowering the user's body through raising and lowering the user's arms while the user is in a face down horizontal position with the present invention exercise device used to simulate an up and down pumping action to cause the user to have his/her arms spread apart to make the pushups more difficult while providing a central chest support to facilitate the exercise.

It has been discovered, according to the present invention, that if an exercise device incorporates a pair of parallel spaced apart rotatable arms with gripping members at their respective distal ends which are held by a respective hand of a user, and which exercise apparatus arms further support at their respective proximal ends a pair of support members which support a central seat or cushion, then the user can simulate a difficult pushup by resting his/her chest against the central seat and raising and lowering his/her body while grasping each grip with a respective hand. As the user pushes down on the grip of each arm, each arm rotates about a pivot point so that the distal end of each arm is rotated downwardly. Concurrently, the proximal end of each arm is caused to rotate upwardly, thereby causing the seat to push against the user's chest to further elevate the user's body. As a user pulls up on the grips, the distal end of each exercise apparatus arm rotates upwardly while the proximal end of each exercise apparatus arm rotates downwardly, causing the seat to be lowered to facilitate the user lowering his/her body but preventing the user's chest from hitting the floor. The device simulates a pump by which the user raises and lowers his/her body by raising and lowering the user's arms while the arms are spread apart to increase the difficulty of the exercise.

It has been further discovered that if the exercise apparatus arms are each pivoted on a U-shaped bracket which is supported on a base, then the entire exercise device is structurally stable to facilitate a safe and easy to use exercise device.

It is therefore an object of the present invention to provide an exercise device to facilitate performing pushups with the arms extending to each respective side of the user to increase the difficulty of the exercise.

It is also an object of the present invention to provide an exercise device which fully supports a user's chest during the pushup exercise.

It is additionally an object of the present invention to provide an exercise device which provides a stable base to enable the user to safely perform a difficult pushup exercise while supporting the user's hands through grip members on the exercise apparatus arms and supporting the user's chest through a support seat on the exercise apparatus.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 3 is a perspective view of a user performing a downward motion on the exercise device wherein each of the user's hands pushes downwardly on a respective grip of an exercise apparatus arm and the arms rotatably cause the seat portion to push upwardly against the user's chest; and FIG. 4 is a perspective view of the exercise apparatus wherein the user now pulls upwardly on each respective grip member of each exercise apparatus arm and the user's chest is lowered but is supported by the central seat member of the exercise apparatus to prevent the user's chest from hitting the floor.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
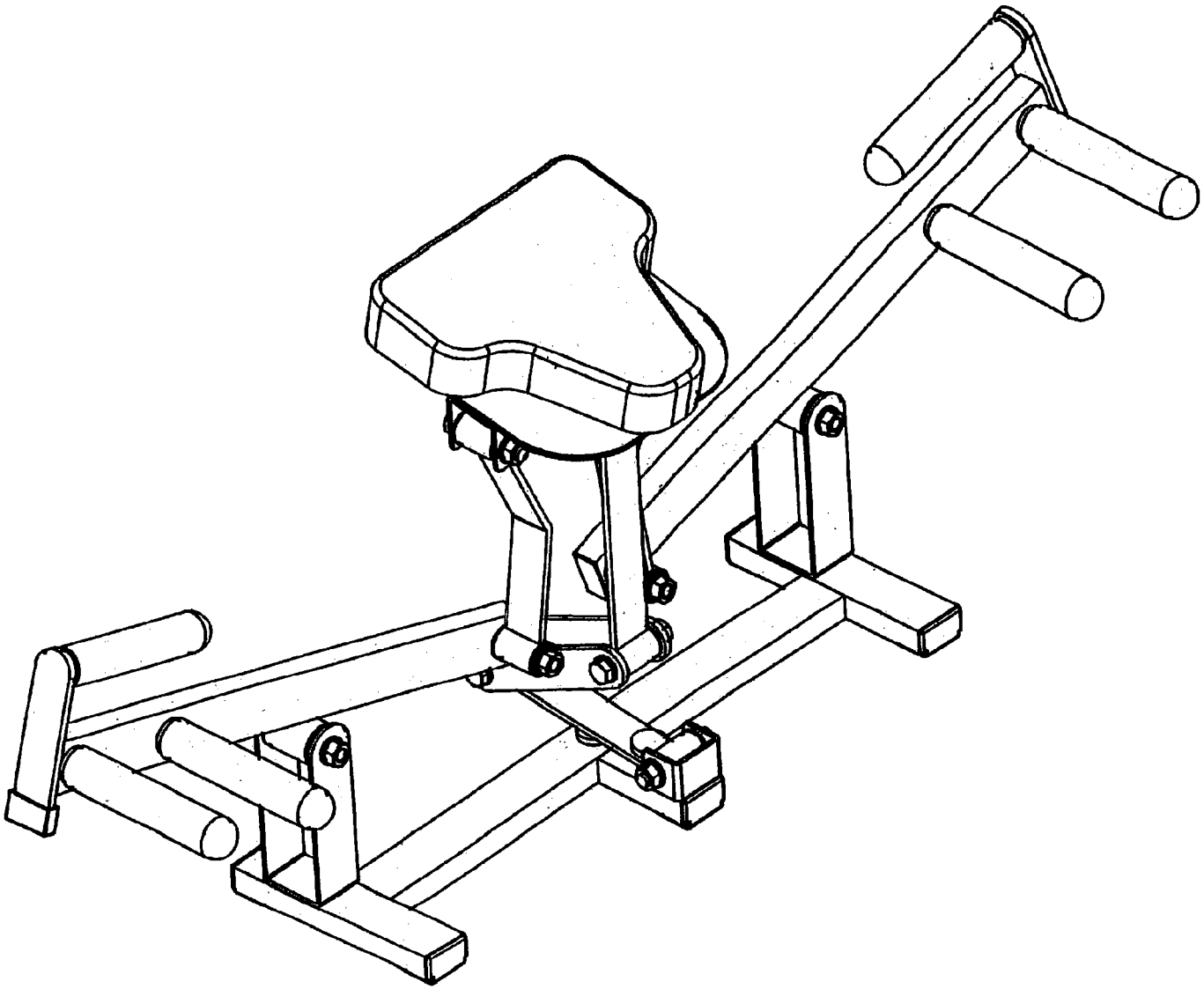
FIG. 1 is a perspective view of the present invention exercise apparatus in the assembled condition.
Figure 2:
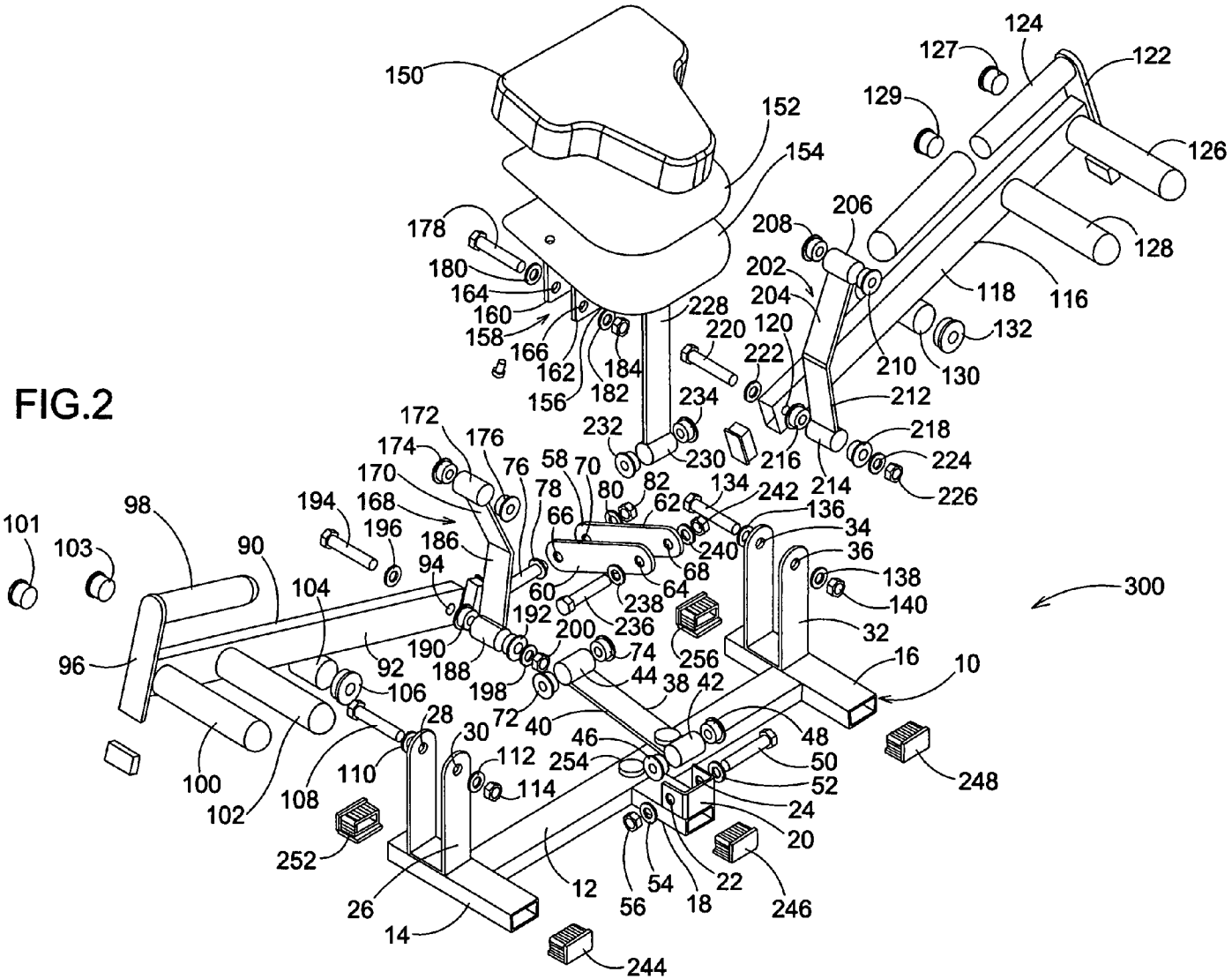
FIG. 2 is an exploded view of the present invention exercise apparatus showing all of the component parts of the present invention exercise apparatus.

The present invention is an exercise device for exercising the arms, chest and shoulder muscles. FIG. 1 is a perspective view of the present invention in the assembled condition and FIG. 2 is an exploded view showing all of the components of the present invention.

The components of the exercise device 300 will be described in detail referring to the exploded view of FIG. 2 and described from the bottom of the device going upward. The exercise device 300 is mounted on a base 10 comprised of a flat elongated bar 12 with a pair of oppositely disposed parallel crossbars 14 and 16 at each respective lengthwise end of the flat elongated bar 12. Extending transversely to the flat elongated bar 12 is a center crossbar 18. The center crossbar 18 has a U-shaped bracket 20 mounted on the end of the crossbar remote from the flat elongated bar 12, with a pair of oppositely disposed parallel openings 22 and 24 in the U-shaped bracket 20. Crossbar 14 has openings which are filled by first plug 244 and second plug 252. Crossbar 16 has two openings which are filled by first plug 248 and second plug 256. Center crossbar 18 has an opening which is filled by plug 246.

Extending transversely to and extending upwardly from the left parallel crossbar 14 is a left elongated U-shaped bracket 26 having a pair of parallel oppositely disposed openings 28 and 30. Extending transversely to and extending upwardly from the right parallel crossbar 16 is a right elongated U-shaped bracket 32 having a pair of parallel oppositely disposed openings 34 and 36.

Positioned transverse to the center of the flat elongated bar 12 is a base connector 38. The base connector has an elongated bar 40 with a proximal hollow cylinder 42 at one end and a distal hollow cylinder 44 at its opposite end. The proximal hollow cylinder 42 has a pair of bushings 46 and 48 at either end. The proximal hollow cylinder 42 and its bushings 46 and 48 are inserted into the U-shaped bracket 20 such that the bushings and cylinder are aligned with openings 22 and 24. A hex bolt 50 with a first washer 52, a second washer 54 and nut 56 serve to rotatably secure the proximal cylinder 42 to the U-shaped bracket 20.

A connector plate is rotatably secured to the distal cylinder 44 in the following manner. The connector plate 58 is comprised of a left elongated plate 60 and a parallel right elongated plate 62. Left elongated plate 60 has a proximal opening 64 adjacent one end and a distal opening 66 adjacent its opposite end. Right elongated plate 62 has a proximal opening 68 adjacent one end and a distal opening 70 adjacent its opposite end. Left elongated plate 60 is aligned parallel to right elongated plate 62 such that openings 66 and 70 are parallel and openings 64 and 68 are parallel. Distal hollow cylinder 44 has a pair of bushings 72 and 74 which combination is inserted between the distal end of elongated plates 60 and 62 so that the distal hollow cylinder 44 and its bushings 72 and 74 are aligned with openings 66 and 70 and rotatably secured to the connecting plate 58 by hex bolt 76 and its washers 78 and 80 and nut 82.

On the left side of the exercise apparatus 300 is a left arm 90 which comprises an elongated bar 92 having a transverse opening 94 adjacent its proximal end and a transverse plate 96 at its distal end to which is attached a left grip 98 which extends above and parallel to the elongated bar 92 and extends toward the proximal end of the elongated bar 92. A pair of spaced apart and parallel stop members 100 and 102 extend transversely to the elongated bar 92 adjacent its distal end. Plug 101 is aligned with stop member 100 and plug 103 is aligned with stop member 102. A hollow cylinder 104 is affixed to the lower surface of the elongated bar 92 such that the cylinder 104 and its pair of oppositely disposed bushings of which only one 106 is shown is inserted between the parallel member of left elongated U-shaped bracket 26 and aligned with openings 28 and 30 so that the hollow cylinder 104 and its bushings are rotatably fastened to left elongated U-shaped bracket 26 by hex bolt 108 and its washers 110 and 112 and a nut 114.

On the right side of the exercise apparatus 300 is a right arm 116 which comprises an elongated bar 118 having a transverse opening 120 adjacent its proximal end and a transverse plate 122 at its distal end and to which is attached a right grip 124 which extends above and parallel to the elongated bar 118 and extends toward the proximal end of the elongated bar 118. A pair of spaced apart and parallel stop members 126 and 128 extend transversely to the elongated bar 118 adjacent its distal end. Plug 127 is aligned with stop member 126 and plug 129 is aligned with stop member 128. A hollow cylinder 130 is affixed to the lower surface of the elongated bar 118 such that the cylinder 130 and its pair of oppositely disposed bushings of which only one 132 is shown is inserted between the parallel members of the right elongated U-shaped bracket 32 and aligned with openings 34 and 36 so that the hollow cylinder 130 and its bushings are rotatably fastened to the right elongated U-shaped bracket 32 by hex bolt 134 and its washers 136 and 138 and a nut 140.

A seat cushion 150 is supported above a seat liner 152 and which seat cushion 150 and its liner 152 are supported on a seat frame 154, all centrally positioned on the exercise device 300. The seat frame 154 has a lower surface 156 to which is affixed a bracket 158 having a pair of spaced apart parallel walls 160 and 162. Parallel wall 160 has a first opening 164 adjacent one end and a second opening (not shown) adjacent its opposite end. Similarly, parallel wall 162 has a first opening 166 adjacent one end and a second opening (not shown) adjacent its opposite end. Openings 164 and 166 are aligned and the oppositely disposed openings adjacent the other end of the walls are also aligned.

The seat frame 154 is supported by a pair of oppositely disposed right and left V-frame members. The left V-frame member 168 is composed of an upper section and a lower section. The upper section 170 terminates at its distal end in a hollow cylinder 172 having a pair of oppositely disposed bushings 174 and 176 at either end. The hollow cylinder 172 and its bushings 174 and 176 are inserted between parallel walls 160 and 162 so that they are aligned with openings 164 and 166 and attached thereto by hex bolt 178 and its washers 180 and 182 and nut 184. The left-frame member 168 is also composed of a lower section 186 connected to the upper section 170 at their respective proximal ends. The lower section 186 also terminates at its distal end in a hollow cylinder 188 having a pair of oppositely disposed bushings 190 and 192 at either end. The lower section 186 is connected to the left arm 90 by having the hollow cylinder 188 and its bushings 190 and 192 aligned with transverse opening 94 in left arm 90 so that a hex bolt 194 and its washers 196 and 198 and a nut 200 connect the hollow cylinder 188 and its bushings 190 and 192 to the left arm 90.

Similarly, right V-frame member 202 is composed of an upper section and a lower section. The upper section 204 terminates at its distal end in a hollow cylinder 206 having a pair of oppositely disposed bushings 208 and 210 at either end. The hollow cylinder 206 and its bushings 208 and 210 are inserted between parallel walls 160 and 162 and aligned with openings in the parallel walls adjacent the end opposite openings 164 and 166 and affixed thereto by a hex bolt, washers and a nut. The right V-frame member is also composed of a lower section 212 connected to the upper section 204 and their respective proximal ends. The lower section 212 also terminates at its distal end in a hollow cylinder 214 having a pair of oppositely disposed bushings 216 and 218 at either end. The lower section 212 is connected to the right arm 116 by having the hollow cylinder 214 and its bushings 216 and 218 aligned with transverse opening 120 in right arm 116 so that a hex bolt 220 and its washers 222 and 224 and a nut 226 connect the hollow cylinder 214 and its bushings 216 and 218 to the right arm 116.

A vertical post 228 is affixed at its distal end to the lower surface 156 of seat frame 154. At its proximal end the post 228 is affixed to a hollow cylinder 230 with bushings 232 and 234 aligned at either end of the hollow cylinder 230. The hollow cylinder 230 and its bushings 232 and 230 are inserted between the proximal end of elongated plates 60 and 62 of connector plate so that the proximal hollow cylinder 230 and its bushings 232 and 234 are aligned with openings 64 and 68 and rotatably secured to the proximal end of the connector plate 58 by hex. bolt 236 and its washers 238 and 240 and nut 242.

The parts list as set forth in the very detailed description of the present invention is as follows:

300 exercise device
10 base
12 flat elongated bar
14 left parallel crossbar
16 right parallel crossbar
18 center cross bar
20 U-shaped bracket on center crossbar
22 left opening—U shaped neck
24 sight opening U-shaped neck
26 left elongated U-shaped bracket
28 opening in left elongated U-shaped bracket
30 opening in left elongated U-shaped bracket
32 right elongated U-shaped bracket
34 opening in right elongated U-shaped bracket
36 opening in right elongated U-shaped bracket
38 base connector
40 bar on base connector
42 proximal hollow cylinder on connector
44 distal hollow cylinder on base connector
46 bushing distal cylinder
48 bushing distal cylinder
50 hex bolt
52 first washer
54 second washer
56 nut
58 connector plate
60 left elongated plate
62 right elongated plate
64 proximal opening
66 distal opening
68 proximal opening
70 distal opening
72 bushing distal hollow cylinder
74 bushing distal hollow cylinder
76 hex bolt
78 washer
80 washer
82 nut
90 left arm
92 elongated bar
94 transverse opening
96 transverse plate
98 left grip
100 left stop member plate 101
102 left stop member plate 103
104 hollow cylinder
106 bushing
108 hex bolt
110 washer
112 washer
114 nut
116 right arm
118 elongated bar
120 transverse opening
122 transverse plate
124 right grip
126 right stop member—plate 127
128 right stop member—plate 129
130 hollow cylinder
132 bushing
134 hex bolt
136 washer
138 washer
140 nut
150 seat cushion
152 seat liner
154 seat framer
156 lower surface—seat frame
158 bracket
160 parallel wall
162 parallel walls
164 first opening
166 first opening
168 left V-frame member
170 upper section
172 hollow cylinder
174 bushing
176 bushing
178 hex bolt
180 washer
182 washer
184 nut
186 lower section left connection to the upper section of their respective proximal ends
188 hollow cylinder
190 bushing
192 bushing
194 hex bolt
194 hex bolt
196 washer
198 washer
200 nut
202 right V-frame member
204 upper section
206 hollow cylinder
208 bushing
210 bushing
212 lower section
214 lower hollow cylinder
216 bushing
220 hex bolt
222 washer
224 washer
226 nut
228 vertical post
230 hollow cylinder
232 bushing
234 bushing
236 hex bolt
238 washer
240 washer
242 nut
244 first plug on crossbar 14
252 second plug on crossbar 14
248 first plug on crossbar 16
256 second plug on crossbar 16
246 plug on center crossbar 18

Although described in great detail, the parts can also be described in broader language. Specifically, the various U-shaped brackets as described above can also be described as connector members. In addition, the elongated bars can also be described as members. This is set forth in the detailed recitation of the claims as set forth in the text reciting the parts in more broad form.

Referring to FIG. 1, described in its broadest terms, the present invention is an exercise apparatus with a base having a center retaining means, a left retaining means and a right retaining means, with a left arm having a grip member and retaining means by which the left arm is rotatably retained by the left retaining means of the base, and a right arm having a grip member and retaining means by which the right arm is rotatably retained by the right retaining means of the base. Further, the complicated apparatus as discussed in Part No. 38 for the base connector and its various components and the connector plate 58 and its various components and the left V-frame member 168 and its various components and the right V-frame member 202 and its various components and the seat assembly 150 and its various components can in general be described as follows. These elements are in fact a seat member rotatably connected to said left arm and said right arm and also rotatably connected to a center connecting means which is also rotatably connected to said center retaining means of said base, and the left arm and the right arm are rotatably connected to said seat member which permits the left arm and the right arm to rotate up and down to simulate a pumping action; whereby the seat member rotates inversely to the arm so that as the arms rotate downwardly, the seat member is caused to rotate upwardly and as the arms are caused to rotate upwardly the seat member is caused to rotate downwardly. This operation is further illustrated in FIGS. 3 and 4. In FIG. 3, the user is performing a downward motion on the exercise apparatus wherein each of the user's hands pushes downwardly on the respective grip of an exercise apparatus so that the arms rotate downwardly and this causes the seat portion to move upwardly and push against the user's chest. Conversely in FIG. 4, the user now pulls upwardly on the grip member so that the arms are caused to rotate upwardly and concurrently, the seat member is lowered and moves downwardly.

Also further defined in more detail, the present invention is as follows:

Defined in detail, the present invention is an exercise apparatus comprising: (a) a base including a flat elongated bar, a left crossbar transversely attached to one end of the flat elongated bar and a right crossbar transversely attached to the opposite end of the flat elongated bar, the left and right crossbars being parallel, a center crossbar attached transversely to one vertical side of the flat elongated bar and at its lengthwise center location, and a U-shaped bracket having parallel openings attached to the center crossbar, a left elongated U-shaped bracket affixed to the left crossbar and extending upwardly therefrom and having a pair of oppositely disposed openings and a right elongated U-shaped bracket affixed to the right crossbar and extending upwardly therefrom and having a pair of oppositely disposed openings; (b) a base connector including a flat elongated bar having a first hollow cylinder with a bushing at each end affixed to a proximal end of the flat elongated bar and a second hollow cylinder with a bushing at each end affixed to a distal end of the flat elongated bar, the first hollow cylinder and its bushings rotatably affixed to the U-shaped bracket attached to the center crossbar of the base; (c) a connector plate having a left elongated plate and a right elongated plate, the plates being spaced apart and parallel to each other and having oppositely disposed parallel openings adjacent a proximal end of each plate and oppositely disposed parallel openings adjacent a distal end of each plate, the distal end of the left elongated plate and right elongated plate rotatably connected to the second hollow cylinder and its bushings of the base connector; (d) a left arm including an elongated bar having a transverse opening adjacent a proximal end and a transverse plate affixed at its opposite distal end with a left grip attached to the transverse plate and extending above and parallel to the elongated bar and extending toward the proximal end of the elongated bar, a pair of spaced apart parallel stop members extending transversely to the elongated bar adjacent its distal end, a hollow cylinder with bushings at either end affixed to a lower surface of the elongated bar, the hollow cylinder and bushings rotatably affixed to the left elongated U-shaped bracket on the base; (e) a right arm including an elongated bar having a transverse opening adjacent a proximal end and a transverse plate affixed at its opposite distal end with a right grip attached to the transverse plate and extending above and parallel to the elongated bar and extending toward the proximal end of the elongated bar, a pair of spaced apart parallel stop members extending transversely to the elongated bar adjacent its distal end, a hollow cylinder with bushings at either end affixed to a lower surface of the elongated bar, the hollow cylinder and bushings rotatably affixed to the right elongated U-shaped bracket on the base; (f) a seat cushion supported above a seat liner, which cushion and liner are supported on a seat frame having a lower surface to which is affixed a bracket having a pair of spaced apart parallel walls with each wall having an opening adjacent each end, the openings adjacent each respective end being aligned; (g) a left V-frame member having an upper section and a lower section attached to each other at their respective proximal ends, the upper section terminating at a distal end in a hollow cylinder having a pair of oppositely disposed bushings at either end, the hollow cylinder and its bushings inserted between a left end of the parallel walls of the bracket on the seat frame and rotatably attached thereto, the lower section also terminating at a distal end in a hollow cylinder having a pair of oppositely disposed bushings at either end, the hollow cylinder and its bushings rotatably connected to the left elongated bar of the left arm at the opening adjacent its proximal end; (h) a right V-frame member having an upper section and a lower section attached to each other at their respective proximal ends, the upper section terminating at a distal end in a hollow cylinder having a pair of oppositely disposed bushings at either end, the hollow cylinder and its bushings inserted between a right end of the parallel walls of the bracket on the seat frame and rotatably attached thereto, the lower section also terminating at a distal end in a hollow cylinder having a pair of oppositely disposed bushings at either end, the hollow cylinder and its bushings rotatably connected to the right elongated bar of the right arm at the opening adjacent its proximal end; and (i) a vertical post affixed at its distal end to the lower surface of the seat frame, the vertical post terminating in a hollow cylinder at its proximal end, the hollow cylinder having bushings at either end, the hollow cylinder and its bushings inserted between the elongated plates of the connector plate at their proximal ends and rotatably attached thereto.

Defined more broadly, the present invention is an exercise apparatus comprising: (a) a base including a flat elongated bar, a left crossbar transversely attached to one end of the flat elongated bar and a right crossbar transversely attached to the opposite end of the flat elongated bar, the left and right crossbars being parallel, a center crossbar attached transversely to one vertical side of the flat elongated bar and at its lengthwise center location, a first base retaining means attached to the center crossbar, a left base retaining means affixed to the left crossbar and extending upwardly therefrom and a right base retaining means affixed to the right crossbar and extending upwardly therefrom; (b) a base connector including a flat elongated bar having a first connecting means affixed to a proximal end of the flat elongated bar and a second connecting means affixed to a distal end of the flat elongated bar, the first connecting means rotatably affixed to the first base retaining means; (c) a connector plate having a left elongated plate and a right elongated plate, the plates being spaced apart and parallel to each other and having retaining means adjacent a proximal end of each plate and retaining means adjacent a distal end of each plate, the distal end of the left elongated plate and right elongated plate rotatably connected through the retaining means to the second connecting means of the base connector; (d) a left arm including an elongated bar having a left connecting means adjacent a proximal end and a transverse plate affixed at its opposite distal end with a left grip attached to the transverse plate and extending above and parallel to the elongated bar and extending toward the proximal end of the elongated bar, at least one stop member extending transversely to the elongated bar adjacent its distal end, a left connecting means affixed to a lower surface of the elongated bar, the left connecting means rotatably affixed to the left base retaining means; (d) a right arm including an elongated bar having a right connecting means adjacent a proximal end and a transverse plate affixed at its opposite distal end with a right grip attached to the transverse plate and extending above and parallel to the elongated bar and extending toward the proximal end of the elongated bar, at least one stop member extending transversely to the elongated bar adjacent its distal end, a right connecting means affixed to a lower surface of the elongated bar, the right connecting means rotatably affixed to the right base retaining means; (f) a seat cushion supported above a seat liner, which cushion and liner are supported on a seat frame having a lower surface to which is affixed a bracket having a pair of spaced apart parallel walls with each wall having a connecting means adjacent each end; (g)a left support member having an upper section and a lower section attached to each other at their respective proximal ends, the upper section terminating at a distal end in an upper connecting means, the upper connecting means inserted between a left end of the parallel walls of the bracket on the seat frame and rotatably attached thereto through the bracket connecting means, the lower section also terminating at a distal end in a lower connecting means, the lower connecting means rotatably connected to the left elongated bar of the left arm through its left connecting means; (h) a right support member having an upper section and a lower section attached to each other at their respective proximal ends, the upper section terminating at a distal end in an upper connecting means, the upper connecting means inserted between a right end of the parallel walls of the bracket on the seat frame and rotatably attached thereto through the bracket connecting means, the lower section also terminating at a distal end in a lower connecting means, the lower connecting means rotatably connected to the right elongated bar of the right arm through its right connecting means; and (i) a vertical post affixed at its distal end to the lower surface of the seat frame, the vertical post terminating in a post connecting means, the post connecting means rotatably connected to the elongated plates of the connector plate at their proximal ends.

Defined more broadly, the present invention is a An exercise apparatus comprising: (a) a base including a center member, a left crossbar transversely attached to one end of the center member and a right crossbar transversely attached to the opposite end of the center member, a center crossbar attached transversely to one vertical side of the center member at its lengthwise center location, a first base retaining means attached to the center crossbar, a left base retaining means affixed to the left crossbar and extending upwardly therefrom and a right base retaining means affixed to the right crossbar and extending upwardly therefrom; (b) a base connector including an elongated member having a first connecting means affixed to a proximal end of the elongated member and a second connecting means affixed to a distal end of the elongated member, the first connecting means rotatably affixed to the first base retaining means; (c) a connector plate having a first retaining means adjacent its proximal end and second retaining means adjacent its distal end, the distal end of the connector plate rotatably connected through the retaining means to the second connecting means of the base connector; (d) a left arm including an elongated member having a left connecting means adjacent a proximal end and a grip attachment means affixed at its opposite distal end with a left grip attached to the grip attachment means and extending above and parallel to the elongated member and extending toward the proximal end of the elongated member, a left connecting means affixed to a lower surface of the elongated member, the left connecting means rotatably affixed to the left base retaining means; (e) a right arm including an elongated member having a right connecting means adjacent a proximal end and a grip attachment means affixed at its opposite distal end with a right grip attached to the grip attachment means and extending above and parallel to the elongated member and extending toward the proximal end of the elongated member, a right connecting means affixed to a lower surface of the elongated member, the right connecting means rotatably affixed to the right base retaining means; (f) a seat cushion supported on a seat frame having a lower surface to which is affixed an elongated connecting means having a left end and a right end; (g) a left support member having a top end and a bottom end, the top end terminating in an upper connecting means which is rotatably connected adjacent to the left end of the seat frame connecting means, the bottom end terminating in lower connecting means which is rotatably connected to left elongated member at its left connecting means; (h) a right support member having a top end and a bottom end, the top end terminating in an upper connecting means which is rotatably connected adjacent to the right end of the seat frame connecting means, the bottom terminating in a lower connecting means which is rotatably connected to the right elongated member at its right connecting means; and (i) a vertical member affixed at its distal end to the lower surface of the seat frame, the vertical member terminating in a connecting means, the connecting means rotatably connected to the connector plate at its proximal ends.

Defined even more broadly, the present invention is a An exercise apparatus comprising: (a) a base having support means including a centrally disposed first base retaining means, an upwardly extending left base retaining means and an upwardly extending right base retaining means; (b) a base connector having first connecting means at one end and second connecting means at its opposite end, the first connecting means rotatably affixed to the first base retaining means; (c) a connector plate having first retaining means adjacent one end and second retaining means adjacent its opposite end, the second retaining means rotatably connected to the second connecting means of the base connector; (d)a left arm having a grip means affixed adjacent its distal end and a left connector means by which the left arm is rotatably attached to the upwardly extending left base retaining means; (d) a right arm having a grip means affixed adjacent its distal end and a right connector means by which the right arm is rotatably attached to the upwardly extending right base retaining means; (f) a seat cushion supported on a seat frame having a lower surface to which is affixed an elongated connecting means having a left end and a right end; (g) a left support member having a top end and a bottom end, the top end terminating in an upper connecting means which is rotatably connected adjacent to the left end of the seat frame connecting means, the bottom end terminating in a lower connecting means which is rotatably connected to the left elongated arm at a left connecting means adjacent its proximal end; (h) a right support member having a top end and a bottom end, the top end terminating in an upper connecting means which is rotatably connected adjacent to the right end of the seat frame connecting means, the bottom end terminating in a lower connecting means which is rotatably connected to the right elongated arm at a right connecting means adjacent its proximal end; and (i)a vertical member affixed at its distal end to the lower surface of the seat frame, the vertical member terminating in a connecting means at its proximal end, the connecting means rotatably connected to the connector plate at its first retaining means.

Defined even more broadly, the present invention is an exercise apparatus comprising: (a) a base having a center retaining means, a left retaining means and a right retaining means; (b) a left arm having a grip member and retaining means by which the left arm is rotatably retained by the left retaining means of the base; (c) a right arm having a grip member and retaining means by which the right arm is rotatably retained by the right retaining means of the base; (d) a seat member rotatably connected to the left arm and the right arm and also rotatably connected to a center connecting means which is also rotatably connected to the center retaining means of the base; and (e) the left arm and the right arm are rotatably connected to the seat member which permits the left arm and the right arm to rotate up and down to simulate a pumping action; (f) whereby the seat member rotates inversely to the arms so that as the arms rotate downwardly, the seat member is caused to rotate upwardly and as the arms are caused to rotate upwardly, the seat member is caused to rotate downwardly.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. An exercise apparatus comprising:

a. a base including a flat elongated bar, a left crossbar transversely attached to one end of the flat elongated bar and a right crossbar transversely attached to the opposite end of the flat elongated bar, the left and right crossbars being parallel, a center crossbar attached transversely to one vertical side of the flat elongated bar and at its lengthwise center location, and a U-shaped bracket having parallel openings attached to the center crossbar, a left elongated U-shaped bracket affixed to said left crossbar and extending upwardly therefrom and having a pair of oppositely disposed openings and a right elongated U-shaped bracket affixed to said right crossbar and extending upwardly therefrom and having a pair of oppositely disposed openings;

b. a base connector including a flat elongated bar having a first hollow cylinder with a bushing at each end affixed to a proximal end of the flat elongated bar and a second hollow cylinder with a bushing at each end affixed to a distal end of the flat elongated bar, the first hollow cylinder and its bushings rotatably affixed to the U-shaped bracket attached to the center crossbar of said base;

c. a connector plate having a left elongated plate and a right elongated plate, the plates being spaced apart and parallel to each other and having oppositely disposed parallel openings adjacent a proximal end of each plate and oppositely disposed parallel openings adjacent a distal end of each plate, the distal end of the left elongated plate and right elongated plate rotatably connected to the second hollow cylinder and its bushings of the base connector;

d. a left arm including an elongated bar having a transverse opening adjacent a proximal end and a transverse plate affixed at its opposite distal end with a left grip attached to the transverse plate and extending above and parallel to the elongated bar and extending toward the proximal end of the elongated bar, a pair of spaced apart parallel stop members extending transversely to the elongated bar adjacent its distal end, a hollow cylinder with bushings at either end affixed to a lower surface of the elongated bar, the hollow cylinder and bushings rotatably affixed to the left elongated U-shaped bracket on said base;

e. a right arm including an elongated bar having a transverse opening adjacent a proximal end and a transverse plate affixed at its opposite distal end with a right grip attached to the transverse plate and extending above and parallel to the elongated bar and extending toward the proximal end of the elongated bar, a pair of spaced apart parallel stop members extending transversely to the elongated bar adjacent its distal end, a hollow cylinder with bushings at either end affixed to a lower surface of the elongated bar, the hollow cylinder and bushings rotatably affixed to the right elongated U-shaped bracket on said base;

f. a seat cushion supported above a seat liner, which cushion and liner are supported on a seat frame having a lower surface to which is affixed a bracket having a pair of spaced apart parallel walls with each wall having an opening adjacent each end, the openings adjacent each respective end being aligned;

g. a left V-frame member having an upper section and a lower section attached to each other at their respective proximal ends, the upper section terminating at a distal end in a hollow cylinder having a pair of oppositely disposed bushings at either end, the hollow cylinder and its bushings inserted between a left end of the parallel walls of the bracket on the seat frame and rotatably attached thereto, the lower section also terminating at a distal end in a hollow cylinder having a pair of oppositely disposed bushings at either end, the hollow cylinder and its bushings rotatably connected to the left elongated bar of the left arm at the opening adjacent its proximal end;

h. a right V-frame member having an upper section and a lower section attached to each other at their respective proximal ends, the upper section terminating at a distal end in a hollow cylinder having a pair of oppositely disposed bushings at either end, the hollow cylinder and its bushings inserted between a right end of the parallel walls of the bracket on the seat frame and rotatably attached thereto, the lower section also terminating at a distal end in a hollow cylinder having a pair of oppositely disposed bushings at either end, the hollow cylinder and its bushings rotatably connected to the right elongated bar of the right arm at the opening adjacent its proximal end; and i. a vertical post affixed at its distal end to the lower surface of said seat frame, the vertical post terminating in a hollow cylinder at its proximal end, the hollow cylinder having bushings at either end, the hollow cylinder and its bushings inserted between the elongated plates of the connector plate at their proximal ends and rotatably attached thereto.

2. An exercise apparatus comprising:

a. a base including a flat elongated bar, a left crossbar transversely attached to one end of the flat elongated bar and a right crossbar transversely attached to the opposite end of the flat elongated bar, the left and right crossbars being parallel, a center crossbar attached transversely to one vertical side of the flat elongated bar and at its lengthwise center location, a first base retaining means attached to the center crossbar, a left base retaining means affixed to said left crossbar and extending upwardly therefrom and a right base retaining means affixed to said right crossbar and extending upwardly therefrom;

b. a base connector including a flat elongated bar having a first connecting means affixed to a proximal end of the flat elongated bar and a second connecting means affixed to a distal end of the flat elongated bar, the first connecting means rotatably affixed to the first base retaining means;

c. a connector plate having a left elongated plate and a right elongated plate, the plates being spaced apart and parallel to each other and having retaining means adjacent a proximal end of each plate and retaining means adjacent a distal end of each plate, the distal end of the left elongated plate and right elongated plate rotatably connected through said retaining means to said second connecting means of said base connector;

d. a left arm including an elongated bar having a left connecting means adjacent a proximal end and a transverse plate affixed at its opposite distal end with a left grip attached to the transverse plate and extending above and parallel to the elongated bar and extending toward the proximal end of the elongated bar, at least one stop member extending transversely to the elongated bar adjacent its distal end, a left connecting means affixed to a lower surface of the elongated bar, the left connecting means rotatably affixed to the left base retaining means;

e. a right arm including an elongated bar having a right connecting means adjacent a proximal end and a transverse plate affixed at its opposite distal end with a right grip attached to the transverse plate and extending above and parallel to the elongated bar and extending toward the proximal end of the elongated bar, at least one stop member extending transversely to the elongated bar adjacent its distal end, a right connecting means affixed to a lower surface of the elongated bar, the right connecting means rotatably affixed to the right base retaining means;

f. a seat cushion supported above a seat liner, which cushion and liner are supported on a seat frame having a lower surface to which is affixed a bracket having a pair of spaced apart parallel walls with each wall having a connecting means adjacent each end;

g. a left support member having an upper section and a lower section attached to each other at their respective proximal ends, the upper section terminating at a distal end in an upper connecting means, the upper connecting means inserted between a left end of the parallel walls of the bracket on the seat frame and rotatably attached thereto through the bracket connecting means, the lower section also terminating at a distal end in a lower connecting means, the lower connecting means rotatably connected to the left elongated bar of the left arm through its left connecting means;

h. a right support member having an upper section and a lower section attached to each other at their respective proximal ends, the upper section terminating at a distal end in an upper connecting means, the upper connecting means inserted between a right end of the parallel walls of the bracket on the seat frame and rotatably attached thereto through the bracket connecting means, the lower section also terminating at a distal end in a lower connecting means, the lower connecting means rotatably connected to the right elongated bar of the right arm through its right connecting means; and i. a vertical post affixed at its distal end to the lower surface of said seat frame, the vertical post terminating in a post connecting means, the post connecting means rotatably connected to the elongated plates of the connector plate at their proximal ends.

3. An exercise apparatus comprising:

a. a base including a center member, a left crossbar transversely attached to one end of the center member and a right crossbar transversely attached to the opposite end of the center member, a center crossbar attached transversely to one vertical side of the center member at its lengthwise center location, a first base retaining means attached to the center crossbar, a left base retaining means affixed to said left crossbar and extending upwardly therefrom and a right base retaining means affixed to said right crossbar and extending upwardly therefrom;

b. a base connector including an elongated member having a first connecting means affixed to a proximal end of the elongated member and a second connecting means affixed to a distal end of the elongated member, the first connecting means rotatably affixed to the first base retaining means;

c. a connector plate having a first retaining means adjacent its proximal end and second retaining means adjacent its distal end, the distal end of the connector plate rotatably connected through said retaining means to said second connecting means of said base connector;

d. a left arm including an elongated member having a left connecting means adjacent a proximal end and a grip attachment means affixed at its opposite distal end with a left grip attached to the grip attachment means and extending above and parallel to the elongated member and extending toward the proximal end of the elongated member, a left connecting means affixed to a lower surface of the elongated member, the left connecting means rotatably affixed to the left base retaining means;

e. a right arm including an elongated member having a right connecting means adjacent a proximal end and a grip attachment means affixed at its opposite distal end with a right grip attached to the grip attachment means and extending above and parallel to the elongated member and extending toward the proximal end of the elongated member, a right connecting means affixed to a lower surface of the elongated member, the right connecting means rotatably affixed to the right base retaining means;

f. a seat cushion supported on a seat frame having a lower surface to which is affixed an elongated connecting means having a left end and a right end;

g. a left support member having a top end and a bottom end, the top end terminating in an upper connecting means which is rotatably connected adjacent to the left end of the seat frame connecting means, the bottom end terminating in lower connecting means which is rotatably connected to left elongated member at its left connecting means;

h. a right support member having a top end and a bottom end, the top end terminating in an upper connecting means which is rotatably connected adjacent to the right end of the seat frame connecting means, the bottom terminating in a lower connecting means which is rotatably connected to the right elongated member at its right connecting means; and i. a vertical member affixed at its distal end to the lower surface of said seat frame, the vertical member terminating in a connecting means, the connecting means rotatably connected to the connector plate at its proximal ends.

4. An exercise apparatus comprising:

a. a base having support means including a centrally disposed first base retaining means, an upwardly extending left base retaining means and an upwardly extending right base retaining means;

b. a base connector having first connecting means at one end and second connecting means at its opposite end, the first connecting means rotatably affixed to the first base retaining means;

c. a connector plate having first retaining means adjacent one end and second retaining means adjacent its opposite end, the second retaining means rotatably connected to the second connecting means of said base connector;

d. a left arm having a grip means affixed adjacent its distal end and a left connector means by which the left arm is rotatably attached to the upwardly extending left base retaining means;

e. a right arm having a grip means affixed adjacent its distal end and a right connector means by which the right arm is rotatably attached to the upwardly extending right base retaining means;

f. a seat cushion supported on a seat frame having a lower surface to which is affixed an elongated connecting means having a left end and a right end;

g. a left support member having a top end and a bottom end, the top end terminating in an upper connecting means which is rotatably connected adjacent to the left end of the seat frame connecting means, the bottom end terminating in a lower connecting means which is rotatably connected to the left elongated arm at a left connecting means adjacent its proximal end;

h. a right support member having a top end and a bottom end, the top end terminating in an upper connecting means which is rotatably connected adjacent to the right end of the seat frame connecting means, the bottom end terminating in a lower connecting means which is rotatably connected to the right arm at a right connecting means adjacent its proximal end; and i. a vertical member affixed at its distal end to the lower surface of said seat frame, the vertical member terminating in a connecting means at its proximal end, the connecting means rotatably connected to the connector plate at its first retaining means.

* * * * *